United States Patent [19]

Kamiya et al.

[11] Patent Number: 4,920,568

[45] Date of Patent: Apr. 24, 1990

[54] METHOD OF DISTINGUISHING VOICE FROM NOISE

[75] Inventors: Shin Kamiya; Toru Ueda, both of Nara, Japan

[73] Assignee: Sharp Kabushiki Kaisha, Osaka, Japan

[21] Appl. No.: 256,151

[22] Filed: Oct. 11, 1988

Related U.S. Application Data

[63] Continuation-in-part of Ser. No. 882,233, Jul. 7, 1986, abandoned.

[30] Foreign Application Priority Data

Jul. 16, 1985 [JP] Japan ..... 60-159149
Jun. 4, 1986 [JP] Japan ..... 61-130604

[51] Int. Cl.[5] ..... G10L 3/00
[52] U.S. Cl. ..... 381/46
[58] Field of Search ..... 381/46, 47, 36–45, 381/110; 364/513.5; 367/198

[56] References Cited

U.S. PATENT DOCUMENTS

| | | | |
|---|---|---|---|
| 4,092,493 | 5/1978 | Rabiner et al. | 381/43 |
| 4,219,695 | 8/1980 | Wilkes et al. | 381/47 |
| 4,359,604 | 11/1982 | Dumont | 381/46 |
| 4,688,256 | 8/1987 | Yasunaga | 381/46 |
| 4,700,392 | 10/1987 | Kato et al. | 381/46 |
| 4,720,862 | 1/1988 | Nakata et al. | 381/38 |

*Primary Examiner*—Gary V. Harkcom
*Assistant Examiner*—John A. Merecki
*Attorney, Agent, or Firm*—Flehr, Hohbach, Test, Albritton & Herbert

[57] ABSTRACT

An inputted sound signal is sampled at intervals over a period and cepstrum coefficients are calculated from the sampled values. Cepstrum sum, distance and/or power are calculated and compared with appropriately preselected threshold values to distinguish voice (vowel) intervals and noise intervals. The ratio of the length of the voice intervals to the sampling period is considered to determine whether the sampled inputted sound signal represents voice or noise.

5 Claims, 4 Drawing Sheets

METHOD OF DISTINGUISHING VOICE FROM NOISE

BACKGROUND OF THE INVENTION

This invention relates to a method of distinguishing voice from noise in order to separate voice and noise periods in an inputted sound signal.

In the past, voice and noise periods in an inputted sound signal were separated by detecting and suppressing only a particular type of noise such as white noise and pulse-like noise. There is an infinite variety of noise, however, and the prior art procedure of choosing a particular noise-suppression method for each type of noise cannot be effective against all kinds of noise generally present.

SUMMARY OF THE INVENTION

It is therefore an object of the present invention to provide a method of distinguishing voice from noise in an inputted sound signal rather than detecting and suppressing only a particular type of noise such that a very large variety of noise can be easily removed by separating voice and noise periods in an inputted sound signal.

The above and other objects of the present invention are achieved by identifying a voice period on the basis of presence or absence of a vowel and separating voice periods which have been identified from noise periods. In other words, the present invention provides a method based on constancy of spectrum whereby vowel periods are detected in an inputted sound signal and voice periods are identified by calculating the ratio of vowel periods with respect to the total length of the inputted sound signal.

BRIEF DESCRIPTION OF THE DRAWINGS

The accompanying drawings, which are incorporated in and form a part of the specification, illustrate an embodiment of the present invention and, together with the description, serve to explain the principles of the invention. In the drawings.

DETAILED DESCRIPTION OF THE INVENTION

Regarding languages such as the Japanese based on vowel-consonant combinations, the following three conditions may be considered for identifying a vowel:

(1) a high-power period, (2) a period during which changes in the spectrum are small (constant voice period), (3) a period during which the distance between the signal and a corresponding standard vowel pattern is small, and (4) a period during which the sum of the absolute values of cepstrum coefficients is large.

According to one embodiment of the present invention, vowel periods are detected on the basis of the first and fourth of the four criteria shown above and separated from noise periods without the necessity of comparing the inputted sound signal with any standard vowel pattern such that voice periods can be identified by means of a simpler hardware architecture.

Figure 1:
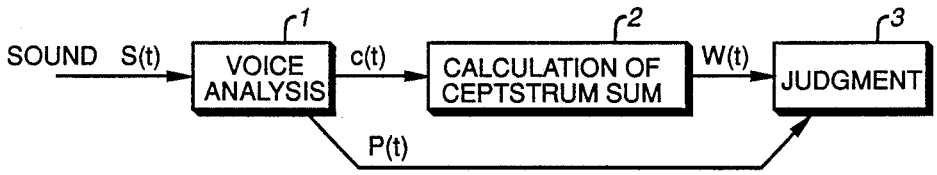
FIG. 1 is a block diagram of a device for distinguishing between voice and noise periods by using a method which embodies the present invention.
Figure 2:
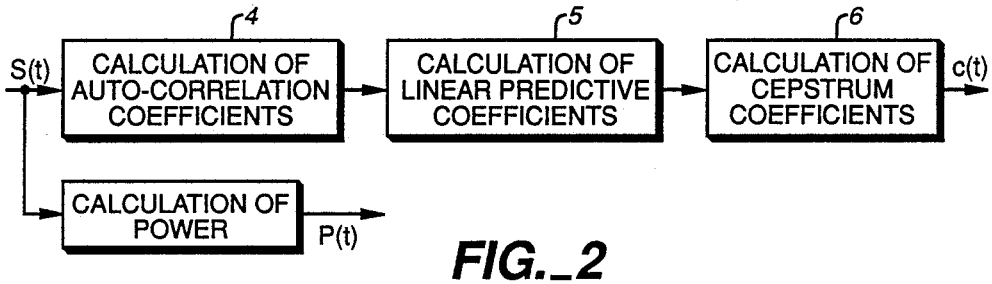
FIG. 2 is a block diagram of the section for voice analysis shown in FIG. 1.

Reference being made to FIG. 1 which is a structural block diagram of a device based on a method according to the aforementioned embodiment of the present invention, numeral 1 indicates a section for voice analysis, numeral 2 indicates a section where cepstrum sum is calculated and numeral 3 indicates a section where judgment is made. The voice analysis section 1 includes, as shown by the block diagram in FIG. 2, a section 4 where auto-correlation coefficients are calculated, a section 5 where linear predictive coefficients are calculated, a section 6 where cepstrum coefficients are calculate, and a section 7 where power is calculated. In the section 4 where auto-correlation coefficients are calculated, 256 sampled values $S_i(t)$ of a sound signal from each frame (where $1 \leqq i \leqq 256$) are used as shown below to obtain the autocorrelation coefficients $R_i$ ($1 \leqq i \leqq np+1$ and the order of analysis $np=24$) according to the flow chart shown in FIG. 3:

$$R_i = \sum_{j=1}^{256-i+1} S_j * S_{i+j-1}$$

Figure 3:
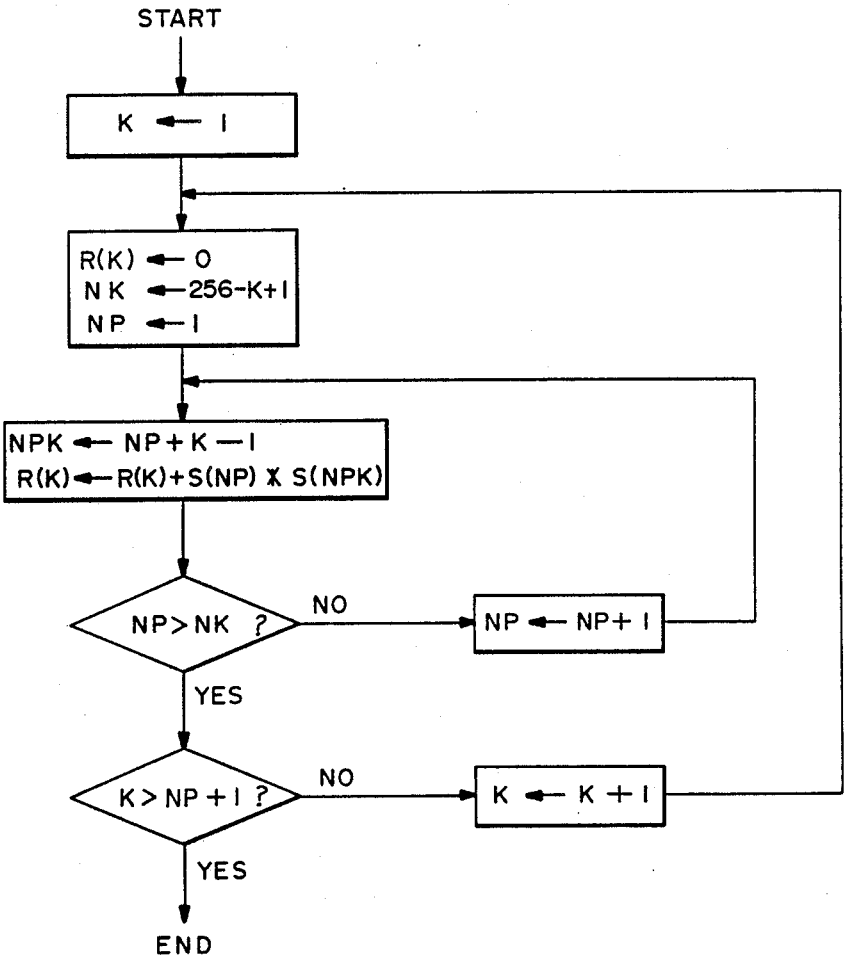
FIG. 3 is a flow chart for the calculation of auto-correlation coefficients.

In FIG. 3, R(K) and S(NP) correspond respectively to $R_i$ and $S_j$ in the expression above.

Figure 4:
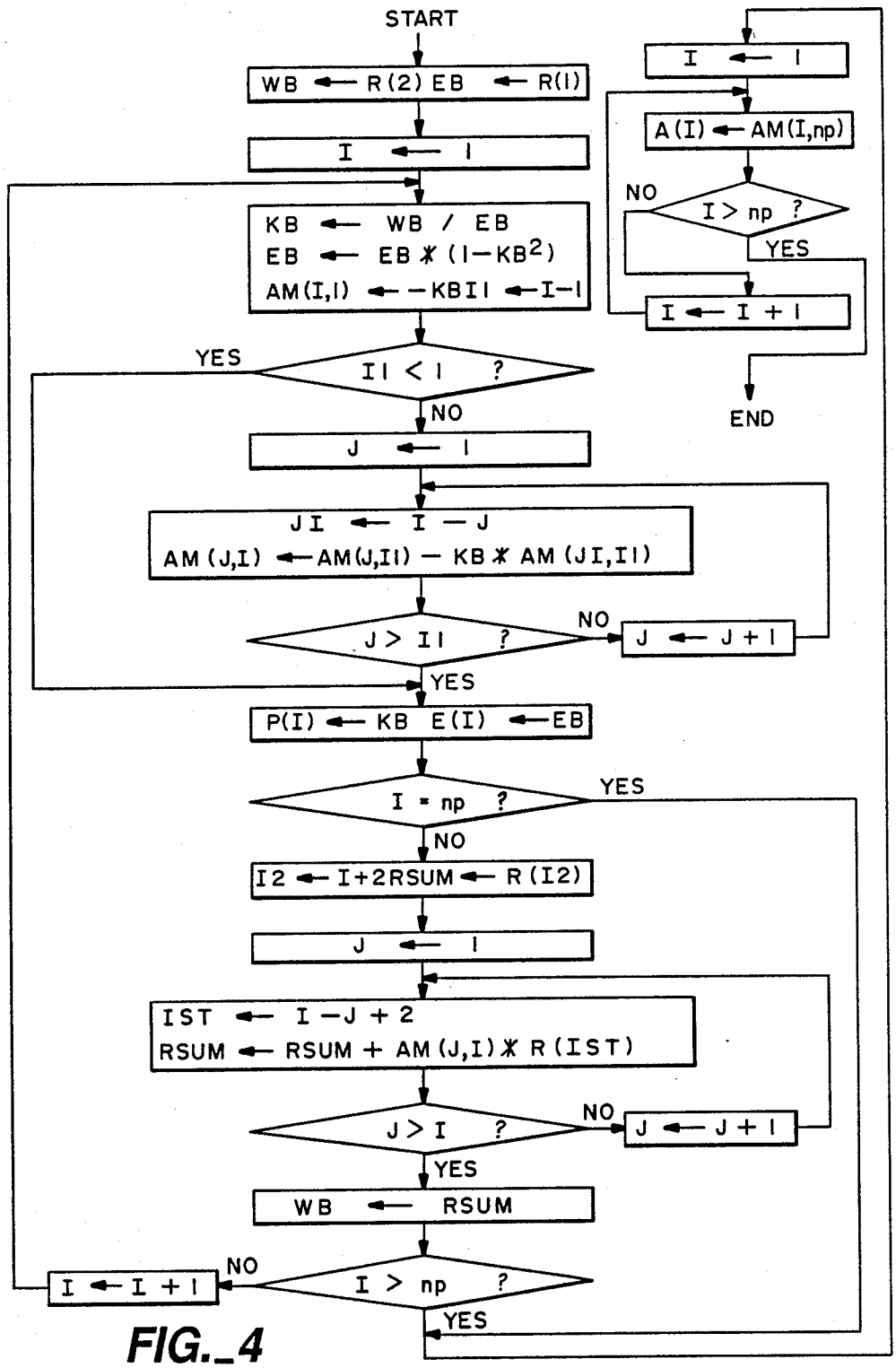
FIG. 4 is a flow chart for the calculation of linear predictive coefficients.

In the section 5 for calculating linear predictive coefficients, the aforementioned auto-correlation coefficients $R_i$ are used as input and the flow chart of FIG. 4 is followed to calculate linear predictive coefficients Ak, partial autocorrelation coefficients $P_k$ and residual power $E_k$ (where $1 \leqq k \leqq np$) and the formula shown below and cepstrum coefficients $c_i$ ($1 \leqq i \leqq np$) are obtained:

$$c_i = -A_i - (1/i) \sum_{k=1}^{i-1} k * c_k * A_{i-k}.$$

In the section 7 for calculating power, the sampled values $S_i$ are used to calculate the power P as follows:

$$P = \sum_{i=1}^{256} |S_i|^2/256$$

An example of the actual operation according to the method disclosed above will be described next. Firstly, a 16-millisecond hanning window is used in the section 1 for voice analysis and an inputted sound signal is sampled at each frame (period=8 millisecond) at 16 kHz. Let $S_i(t)$ denote the sampled values obtained at time t ($1 \leqq i \leqq 256$). Power P and LPC cepstrum c are thus obtained every 8 milliseconds from the sampled values $S_i(t)$.

The values of power and LPC (linear predictive coding) cepstrum corresponding to the tth frame are respectively written as P(t) and c(t). The values of c(t) thus obtained are inputted to the next section 2 which calculates a low-order (=24) sum of the absolute values of the cepstrum coefficients as follows and outputs it as the cepstrum sum W(t):

$$W(t) = \sum_{i=1}^{24} |c(i)|.$$

Both the cepstrum sum W(t) thus obtained and the power P(t) are received by the judging section 3.

Figure 5:
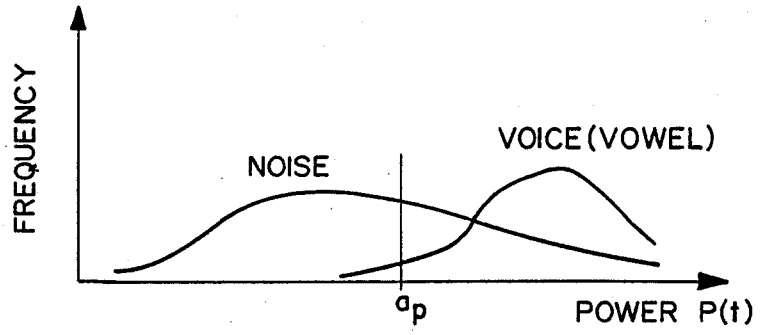
FIG. 5 is a graph of frequency distributions of power for noise and voice.
Figure 6:
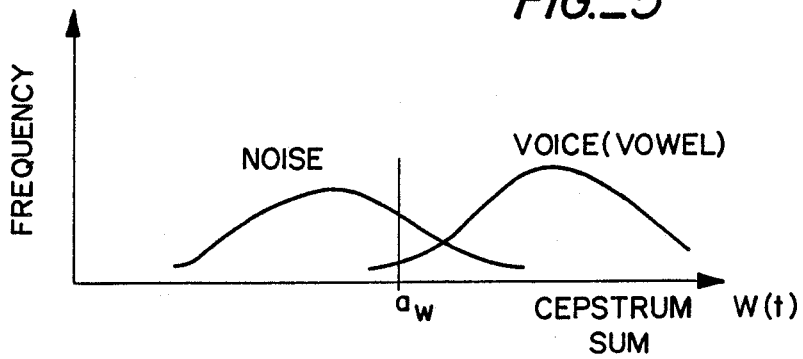
FIG. 6 is a graph of frequency distribution of cepstrum sum for noise and voice.

FIGS. 5 and 6 are graphs showing the frequency distributions respectively of power and cepstrum sum for noise and voice (vowel). Threshold values $a_P$ and $a_W$ for distinguishing voice from noise, by way respectively of power and cepstrum sum, are selected with respect to these distribution curves so as to be slightly on the side of the peak representing noise from the point where the noise and voice curves cross each other. This is so as to avoid situations of missing voice by setting thresholds too far to the side of voice. If the power P(t) is greater than the power threshold value $a_p$ and the cepstrum sum W(t) is greater than $a_W$, the judging section 3 concludes that the frame is inside a vowel period. Next, a time interval $t_1 < t < t_2$ is considered such that $t_2 - t_1 > 84$ frames. If 21 or more of the frames within this interval are identified as sound period and if the number of frames identified as representing a vowel is one-fourth or more of the sound period, it is concluded that the interval in question ($t_1 < t < t_2$) is a voice period. If the ratio is less than one-fourth, on the other hand, it is concluded to be a noise period.

According to a second embodiment of the present invention, the second of the four aforementioned criteria, or the constancy characteristic of the spectrum, is considered to identify vowel periods and to separate them from noise periods. If the ratio in length between sound and vowel periods is large, it is concluded that it is very likely a voice period. By this method, too, the inputted sound signal need not be compared with any standard vowel pattern and hence the third of the criteria can be ignored. Moreover, the determination capability is not dependent on the strength of the inputted sound and voice periods can be identified by means of a simple hardware architecture.

Figure 7:
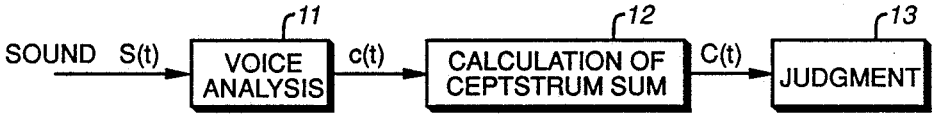
FIG. 7 is a block diagram of another device using another method embodying the present invention.
Figure 8:
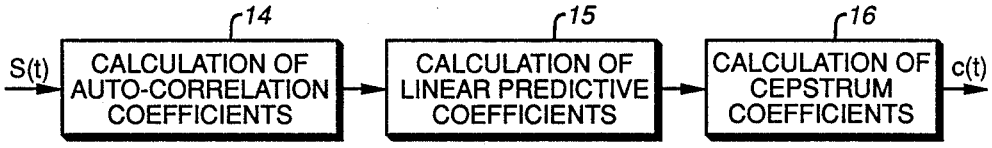
FIG. 8 is a block diagram of the section for voice analysis shown in FIG. 7.

FIG. 7 is a structural block diagram of a device based on the second embodiment of the present invention described above, comprising a section 11 for voice analysis, a section 12 where cepstrum distance is calculated and a judging section 13. As shown in FIG. 8, the voice analysis section includes a section 14 where auto-correlation coefficients are calculated, a section 15 where linear predictive coefficients are calculated, and a section 16 where cepstrum coefficients are calculated. In the section 4 where auto-correlation coefficients are calculated, 256 sampled values $S_i(t)$ of a sound signal from each frame (where $1 \leqq i \leqq 256$) are used as explained above in connection with FIGS. 1 and 2, and autocorrelation coefficients $R_i$ (where $1 \leqq i \leqq np+1$ and $np=24$) are similarly calculated. Linear predictive coefficients $A_k$, partial auto-correlation coefficients $P_k$ and residual power $E_k$ (where $1 \leqq k \leqq np$) are calculated in the section 15 and cepstrum coefficients $c_i$ are obtained in the section 16.

An example of actual operation according to the method disclosed above will be described next for illustration. Firstly, a 32-millisecond hanning window is used in the voice analysis section 11 to sample an inputted sound signal at each frame (period=16 millisecond) at 8 kHz. After autocorrelation coefficients $R_i(t)$ and cepstrum coefficients $c_i(t)$ (where $1 < i < np+1$ and t indicating the frame) are obtained as explained above, they are inputted to the section 12 for calculating cepstrum distance and low-order (up to the 24th order) variations in cepstrum coefficients $$\sum_{i=1}^{24} |c_i(t-1) - c_i(t)|$$

are obtained and outputted as cepstrum distance C(t). Instead of the aforementioned cepstrum distance C(t), use may be made of the auto-correlation distance $$\sum_{i=1}^{24} |R_i(t-1) - R_i(t)|.$$

Figure 9:
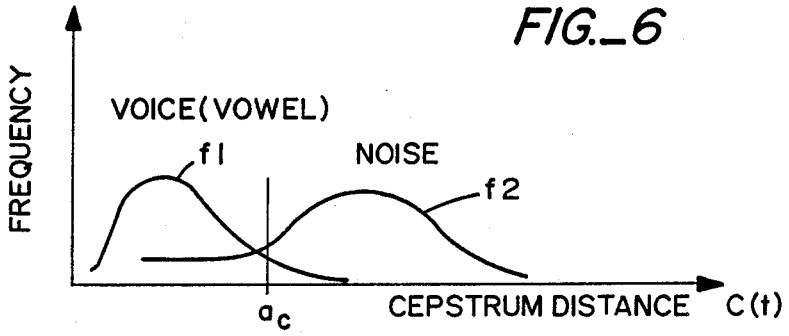
FIG. 9 is a graph of frequency distribution of cepstrum distance for noise and voice.
Figure 10:
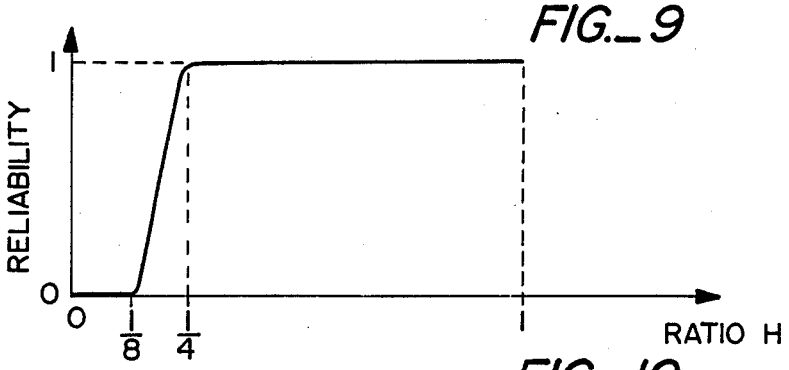
FIG. 10 is a graph showing an example of relationship between the ratio of the length of a vowel period to the length of an inputted sound signal and the reliability of the conclusion that the given period is a vowel period.

The cepstrum distances C(t) thus obtained with respect to the individual frames in an interval $t_1 < t_2$ (where $t_2 - t_1 > 42$ frames) are sequentially inputted to the section 13 where the results are evaluated as follows. As shown in FIG. 9, the frequency distribution curves of cepstrum distance for voice (vowel) and noise (respectively indicated by $f_1$ and $f_2$) have peaks at different positions, crossing each other somewhere between the two peak positions. A threshold value $a_C$ for distinguishing voice from noise by way of cepstrum distance is selected as shown in FIG. 9 at a point slightly removed from the crossing point of the two curves $f_1$ and $f_2$ towards the noise peak for the same reason as given above in connection with FIGS. 5 and 6. If the cepstrum distance C(t) is smaller than this threshold value $a_C$, this means that variations in the spectrum are small and hence it is concluded that this frame is within a vowel period. If C(t) is greater than the threshold value $a_C$, on the other hand, it is concluded that this frame is not within a vowel period. If an interval $t_1 < t < t_2$ contains 10 or more frames with a sound signal and if the ratio H of the number of frames which are determined to be within a vowel period with respect to the total length of the sound signal is greater than a predefined value such as ¼, reliability V ($0 \leqq V \leqq 1$) of the conclusion that the interval $t_1 < t < t_2$ lies within a voice period is considered very large and it is in fact concluded as a voice period. If H is small, on the other hand, V becomes small and it is concluded not to be a voice interval. FIG. 10 shows a predefined relationship between the ratio H and the reliability V.

In summary, voice periods and noise periods within an inputted sound signal can be distinguished and separated according to the embodiment of the present invention described above on the basis of the relationship between a threshold value and the ratio of the length of vowel period with respect to that of the inputted sound signal. A significant characteristic of this method is that there is no need for matching a given signal with any standard vowel pattern in order to detect a vowel period. As a result, voice periods can be identified by means of a very simple hardware architecture. FIG. 10 shows only one example of relationship between the ratio H and reliability V. This relationship may be modified in any appropriate manner.

The foregoing description of preferred embodiments of the invention has been presented for purposes of illustration and description. It is not intended to be exhaustive or to limit the invention to the precise form disclosed, and obviously many modifications and variations are possible in light of the above teaching. Such modifications and variations that may be apparent to a person skilled in the art are intended to be included within the scope of this invention.

What is claimed is:

1. A method of distinguishing voice from noise in a sound signal comprising the steps of sampling a sound signal periodically at a fixed frequency over a sampling period to obtain sampled values, dividing said sampling period equally into a plural N-number of intervals, identifying each of said intervals as a vowel interval, a noise interval or a no-sound interval by a predefined identification procedure, obtaining an $N_1$-number which is the total number of said intervals identified as a vowel interval, and an $N_2$-number which is the total number of said intervals identified as a noise interval, and concluding that said sampling period is a voice period if $(N_1+N_2)/N$ is greater than a predetermined first critical number $r_1$ and $N_1/(N_1+N_2)$ is greater than a predetermined second critical number $r_2$, said predefined procedure for each of said intervals including the steps of calculating a power value from the absolute squares of said sampled values, calculating a cepstrum sum from the absolute values of linear predictive (LPC) cepstrum coefficients obtained from said sampled values, and identifying said interval to be a vowel interval if said power value is greater than an empirically predetermined first threshold value and said cepstrum sum is greater than an empirically predetermined second threshold value.

2. The method of claim 1 wherein said LPC cepstrum coefficients are obtained by calculating auto-correlation coefficients from said sampled values and linear predictive coefficients from said auto-correlation coefficients.

3. The method of claim 1 wherein said threshold values are selected between the peaks of frequency distribution curves of power and cepstrum sum representing noise and vowel, respectively.

4. The method of claim 1 wherein said first critical number $r_1$ is about 10/42 and said second critical number $r_2$ is about $\frac{1}{4}$.

5. The method of claim 1 wherein said fixed frequency is 16 kHz.

* * * * *